United States Patent [19]

Long

[11] Patent Number: 4,474,834

[45] Date of Patent: Oct. 2, 1984

[54] METHOD OF MAKING POLYMERIC-COATED FABRIC

[75] Inventor: Delmar D. Long, Rock Hill, S.C.

[73] Assignee: Dayco Corporation, Dayton, Ohio

[21] Appl. No.: 482,364

[22] Filed: Apr. 5, 1983

[51] Int. Cl.[3] ..... B05D 1/00

[52] U.S. Cl. ..... 427/209; 427/358

[58] Field of Search ..... 427/209, 358

[56] References Cited

U.S. PATENT DOCUMENTS 4,062,989 12/1977 Long ..... 427/176

4,205,559 6/1980 Long et al. ..... 74/233

*Primary Examiner*—Bernard D. Pianalto

*Attorney, Agent, or Firm*—Joseph V. Tassone

[57] ABSTRACT

A polymeric-coated fabric layer, product utilizing the layer and a method of making such layer are provided, the layer having opposed surfaces one of which is adapted to be secured to a surface of a polymeric product and the other of which is adapted to be a contact face for the product and comprising a fabric layer having opposed sides, and two layers of polymeric material secured in stacked relation to one of the sides of the fabric layer with the outer layer of polymeric material defining the one surface of the polymeric-coated fabric layer, only the intermediate polymeric layer initially having a slip agent therein that under certain conditions will migrate through the outer polymeric layer to the outer surface thereof to provide a degree of reduction in the surface coefficient of friction for the contact face of the product.

9 Claims, 5 Drawing Figures

METHOD OF MAKING POLYMERIC-COATED FABRIC

BACKGROUND OF THE INVENTION

1. Field of the Invention

This invention relates to an improved polymeric-coated fabric layer means and a polymeric product utilizing such fabric layer means as well as to a method for making such a fabric layer means.

2. Prior Art Statement

It is known in the art to provide a polymeric-coated fabric layer means having opposed surfaces one of which is adapted to be secured to a surface of a polymeric product and the other of which is adapted to be a contact face for the product, the fabric layer means comprising a fabric layer having opposed sides, and two layers of polymeric material secured in stacked relation to one of the sides of the fabric layer with the outer layer of polymeric material defining the one surface of the layer means. For example, see the U.S. Pat. No. 4,062,989 to Long, and the U.S. Pat. No. 4,205,559, to Long et al.

SUMMARY OF THE INVENTION

It is one feature of this invention to provide an improved polymeric-coated fabric layer means adapted to be secured to a surface of a polymeric product, such as an endless transmission belt construction and the like.

In particular, it is well known that the control of the coefficient of friction on the contact face or surface of a V-belt structure has long been sought in order to aid in the control of clutching systems as well as improving the product life. The inclusion of slip agents into dry rubber stocks has shown limited success, due in part to the inability to disperse sufficient quantities of agents and in part to uniformity of the dispersant. Also cured stock adhesion values can be of question.

However, it was found according to the teachings of this invention that certain slip agents, such as a low molecular weight polyethylene, when introduced into fiber bundles in combination with a polymeric material, such as a neoprene or elastomeric latex, and subsequently overcoated with an additional polymeric material, such as a latex, not bearing the slip agent will under certain cure conditions migrate from the fiber bundles to the outer surface of the cured structure and thereby impart, depending on the level of the slip agent, a degree of reduction in the surface coefficient of friction.

Accordingly, it is believed according to the teachings of this invention that such an improved reduction in the surface coefficient of friction for a belt construction or other product can be provided by utilizing the above unique feature of this invention in a polymeric-coated fabric layer means.

For example, one embodiment of this invention provides a polymeric-coated fabric layer means having opposed surfaces one of which is adapted to be secured to a surface of a polymeric product and the other of which is adapted to be a contact face for the product, the fabric layer means comprising a fabric layer having opposed sides, and two layers of polymeric material secured in stacked relation to one of the sides of the fabric layer with the outer layer of polymeric material defining the one surface of the layer means and with only the intermediate polymeric layer initially having a slip agent therein that under certain conditions will migrate through the outer polymeric layer to the outer surface thereof to provide a degree of reduction in the surface coefficient of friction for the contact face of the product.

Accordingly, it is an object of this invention to provide an improved polymeric-coated fabric layer means, the method of this invention having one or more of the novel features of this invention as set forth above or hereinafter shown or described.

Another object of this invention is to provide an improved product utilizing such a polymeric-coated fabric layer means, the product of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
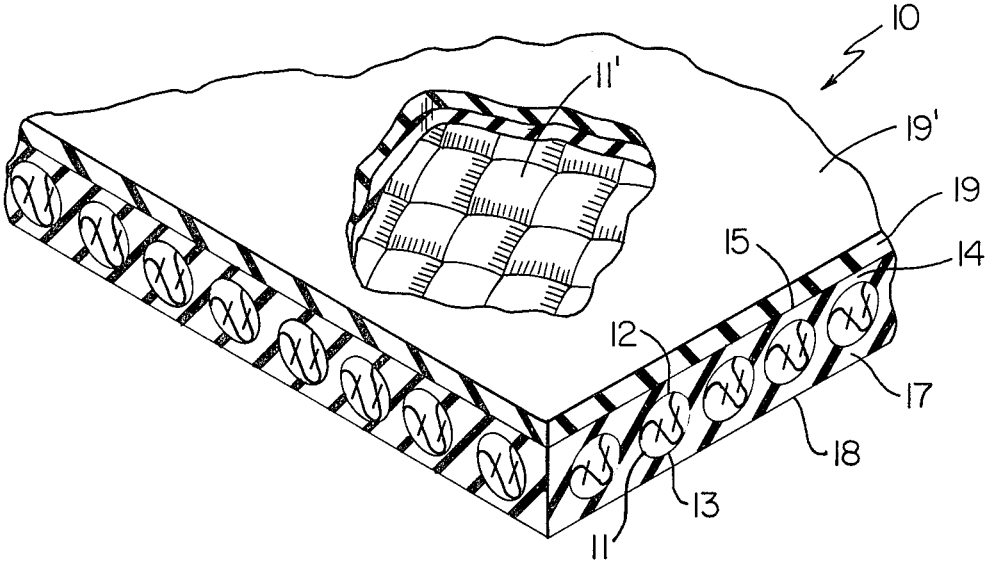
FIG. 1 is an enlarged, partially broken away, cross-sectional perspective view of the polymeric-coated fabric layer means of this invention.

While the various features of this invention are hereinafter illustrated and described as being particularly adapted to provide a polymeric-coated fabric layer means for making particular products, it is to be understood that the various features of this invention can be utilized singly or in various combinations thereof to provide a polymeric-coated fabric layer means for other used and/or other products as desired.

Therefore, this invention is not to be limited to only the embodiment illustrated in the drawings, because the drawings are merely utilized to illustrate one of the wide variety of uses of this invention.

Referring now to FIG. 1, the improved polymeric-coated fabric layer means of this invention is generally indicated by the reference numeral 10 and comprises a suitable fabric layer 11 of a type well known in the art, such as a bias fabric layer, having opposed sides 12 and 13 and a first or intermediate layer 14 of polymeric material secured to the side 12 of the fabric layer 11 in a manner hereinafter set forth and having an outer substantially flat surface 15, the polymeric layer 14 of this invention comprising any suitable polymeric layer, such as a latex layer, which has a slip agent of any suitable type disposed therein, such as a low molecular weight polyethylene. It is believed that when such polymeric layer 14 is applied in liquid form to the side 12 of the fabric layer 11 in a manner hereinafter set forth, the slip agent therein will be introduced into the fiber bundles 11' of the fabric layer 11 in such a manner that the slip agent will migrate therefrom through an additional polymeric layer 19 disposed in stacked relation on the polymeric layer 14 in a manner hereinafter set forth to the outer surface 19' thereof under certain "cure" conditions and thereby impart a degree of reduction in the surface coefficient of friction of the surface 19'. However, it is believed according to the teachings of this invention that such additional polymeric layer 19 must initially be applied to the layer 14 without having any slip agent in the polymeric material 19.

The use of a suitable slip agent in the outer polymeric layer of a polymeric-coated fabric means for belt constructions is disclosed in the copending patent application of Delmar D. Long, Ser. No. 350,969, filed Feb. 22, 1982. Since this copending patent application describes the various uses of polymeric-coated fabric layer means and a method and apparatus for making the same which is similar to this invention as will be apparent hereinafter, this copending patent application is being incorporated into this disclosure by this reference thereto.

In addition, the aforementioned U.S. Pat. No. 4,062,989 to Long and No. 4,205,559 to Long et al, are also being incorporated into this disclosure by this reference thereto as such U.S. patents disclose other types of polymeric-coated fabric layer means for uses similar to the uses of the polymeric-coated fabric layer means 10 of this invention.

Another layer 17 of polymeric material, such as a latex, is secured to the other side 13 of the fabric layer 11 so as to define a surface 18 thereof which will subsequently be secured to a surface of a desired polymeric product, such as a belt body or the like. If desired, the surface 18 of the layer 17 can be provided with a tacky layer for this securement purpose as fully set forth in the aforementioned copending patent application Ser. No. 350,969, filed Feb. 22, 1982.

Figure 2:
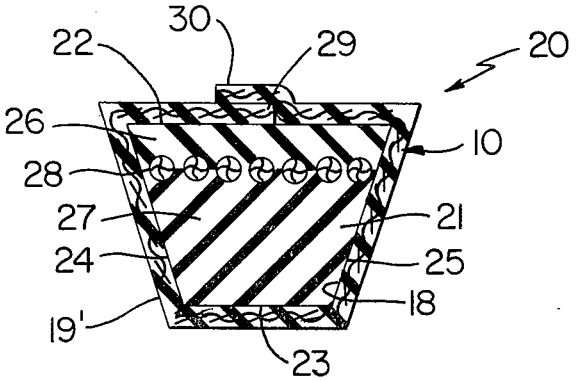
FIG. 2 is a cross-sectional view of an endless power transmission belt construction or the like utilizing the layer means of this invention that is illustrated in FIG. 1.

For example, reference is now made to FIG. 2 wherein a product of this invention is generally indicated by the reference numeral 20 and comprises endless power transmission belt of a typical "V" type wherein the polymeric body 21 thereof has a substantially trapezoidal cross-sectional configuration defined by a pair of opposed flat parallel top and bottom surfaces 22 and 23 with a pair of angled side surfaces 24 and 25 disposed therebetween, the belt construction 20 having the conventional tension section 26, compression section 27 and load-carrying section 28 disposed intermediate the tension section 26 and compression section 27 in a manner well known in the art.

As is conventional in the art, the opposed angular surfaces 24 and 25 of the belt construction 20 are each adapted to have a friction layer, that comprises a fabric impregnated with a polymeric composition, secured thereon by such friction layer either being disposed only on the surfaces 24 and 25 thereof or by having the entire outside surface of the belt body 21 wrapped with the friction layer.

In any event, it can be seen that the belt construction 20 illustrated in FIG. 2 is completely wrapped by a strip of the polymeric-coated fabric layer means 10 of this invention so that the opposed ends 29 and 30 of the layer means 10 are disposed and secured in overlapping relation, such as on the top surface 22 of the belt construction 20 as illustrated in FIG. 2 and is conventional in the belt making art.

When utilizing the layer means 10 of this invention for forming the belt construction 20 of FIG. 2, it can be seen that the side or surface 18 of the layer means 10 is disposed in contact with the outer surfaces 22, 23, 24 and 25 of the polymeric body 21 of the belt construction 20 so as to readily conform to such surfaces 22, 23, 24 and 25 during a subsequent heat curing or vulcanizing of the belt construction 20 after the layer means 10 has been wrapped on the belt body 21 in a manner well known in the art of making belt constructions.

As illustrated in FIG. 2, the outer surface 19' of the layer 19 provides the contact facing of the belt construction 20 at the driving or driven sides 24 and 25 thereof as is conventional in the art.

It is believed according to the teachings of this invention that when the wrapped belt construction 20 is being heat cured to not only vulcanize the polymeric material thereof, but also to vulcanize the layer means 10 to the belt body 21, such curing condition causes the slip agent in the layer 14 and bundles 11' of the fabric layer 11 to migrate through the outer layer 19 to the surface 19' thereof at a controlled rate so as to impart a desired degree of reduction in the surface coefficient of friction thereof in a manner that would not be provided if the slip agent were also initially disposed in the outer polymeric layer 19 before the heat curing operation.

While the layer means 10 of this invention has been previously described as forming an outside surface of a belt product, it is to be understood that the layer means 10 of this invention can provide not only an outside surface thereof but also in addition thereto or in lieu thereof could form part of an inner layer of the belt product if desired.

Also, while the layer means 10 of this invention has been previously described as forming a part or parts of a belt construction or the like, it is to be understood that there are other products that can utilize the layer means 10 of this invention. For example, the layer means 10 can provide part or all of a brake or clutch face, gasket means, etc., whereby it can be seen that the layer means 10 of this invention can be utilized as a product itself or with other products not disclosed in this application because it is believed that the same is readily adapted to be utilized where any such polymeric-coated fabric layer means is presently being used or where such polymeric-coated fabric layer means could possibly be used.

Figure 4:
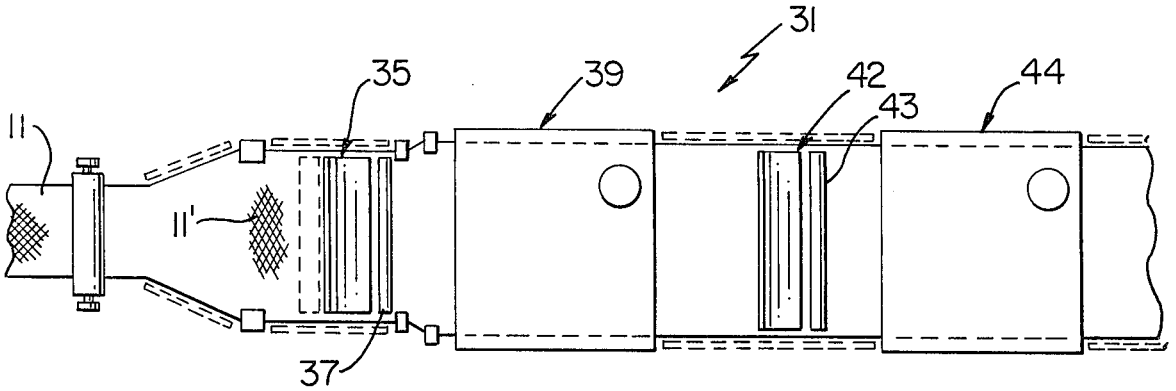
FIG. 4 is a schematic, fragmentary, reduced top view of the apparatus of FIG. 3.
Figure 3:
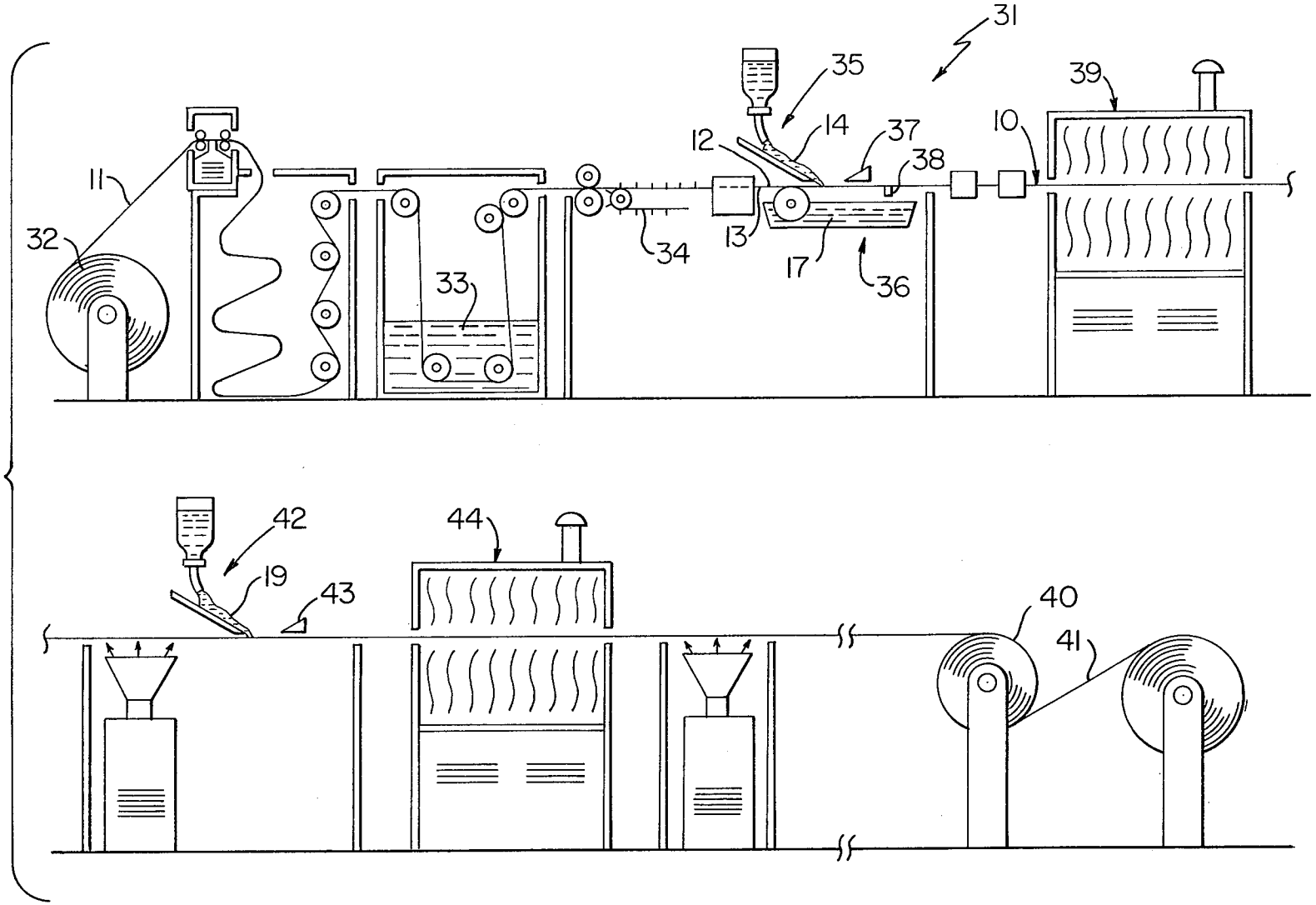
FIG. 3 is a schematic view illustrating the method and apparatus of this invention for making the polymeric-coated fabric layer means of FIG. 1.

While the layer means 10 of this invention is hereinafter illustrated and described as being formed by a particular method and apparatus as illustrated in FIGS. 3 and 4, it is to be understood that this invention is not to be limited to the specific method and apparatus illustrated in FIGS. 3 and 4 as the same is merely being disclosed as a believed to be possible method and apparatus for making the layer means 10 of this invention.

Therefore, reference is now made to FIGS. 3 and 4 wherein a method and apparatus of this invention for forming the layer means 10 of FIG. 1 is generally indicated by the reference numeral 31 and will now be described.

As illustrated in FIG. 3, the fabric layer 11 is fed from a supply roll 32 thereof through a liquid 33 that impregnates and lubricates the threads thereof so that the same can be readily stretched on a tenter frame 34 in a direction transverse to the longitudinal direction of the fabric sheet 11. Thereafter, the polymeric material 14 in liquid form and with the slip agent therein is applied to the top surface 12 of the fabric sheet while simultaneously the polymeric material 17 in liquid form is being applied to the bottom surface 13 of the fabric sheet 11 by respective coating means that are generally indicated by the reference numerals 35 and 36 in FIG. 3, such liquid materials 14 and 17 being respectively doctored by suitable doctor means 37 and 38 disposed on opposite sides of the now coated fabric sheet 11. The coatings 14 and 17 are sufficiently liquid to impregnate the fiber bundles 11' of the fabric layer 11 so as to provide good adhesion of the layers 14 and 17 to the fabric layer 11.

The coated sheet 11 is now passed through a heating means that is generally indicated by the reference numeral 39 for substantially drying the coatings 14 and 17 without curing the same.

The method and apparatus 31 of this invention is also adapted to provide the polymeric layer 19 on the layer means 14 of the polymeric-coated fabric layer means 10 if desired. For example, such polymeric material 19 can be applied in liquid form by a suitable applicator means that is generally indicated by the reference numeral 42 in FIG. 3 and can be doctored by suitable doctor means 43 which provides a desired thickness to the overcoating 19 above the entire surface 15 of the layer 14.

After the overcoating 19 is applied to the side 15 of the layer 14, the polymeric-coated fabric layer means 10 is passed through a heating means 44 which substantially dries the overcoating 19, without curing the polymeric material 14, 17 and 19, before the polymeric-coated fabric layer means 10 of this invention is wound into a supply roll 40 thereof with a sheet 41 wound therewith to prevent the wound polymeric-coated fabric layer means 10 of this invention from securing to itself in the roll 40 as is well known in the art.

Therefore, it can be seen that when it is desired to utilize the layer means 10 of this invention, a sufficient quantity thereof can be dispensed from the supply roll 40 thereof to be utilized either by itself when subsequently heat cured or remaining uncured or in combination with a polymeric product, such as by forming the belt construction 20 in the manner previously described, whereby it can be seen that this invention provides an improved polymeric-coated fabric layer means 10 having opposed surfaces one of which is adapted to be secured to a surface of a polymeric product and the other of which is adapted to be a contact face for the product, the fabric layer means 10 comprising a fabric layer 11 having opposed sides 12 and 13 and two layers 14 and 19 of polymeric material secured in stacked relation to the side 12 of the fabric layer 11 with the outer layer 19 of polymeric material defining the one surface of said fabric layer means and with only the intermediate polymeric layer 14 initially having a slip agent therein that under certain conditions will migrate through the outer polymeric layer to the outer surface thereof to provide a degree of reduction in the surface coefficient of friction for the contact face of the product.

Accordingly, it can be seen that this invention not only provides an improved polymeric-coated fabric layer means and method of making the same, but also this invention provides an improved product utilizing such a layer means.

While the forms and methods of this invention now preferred have been illustrated and described as required by the Patent Statute, it is to be understood that other forms and method steps can be utilized and still fall within the scope of the appended claims.

What is claimed:

1. In a method of making a polymeric-coated fabric layer means having opposed surfaces one of which is adapted to be secured to a surface of a polymeric product and the other of which is adapted to be a contact face for said product, said method comprising the steps of forming said fabric layer means to comprise a fabric layer having opposed sides and fiber bundles, and securing two layers of polymeric material in stacked relation to one of said sides of said fabric layer with the intermediate layer of polymeric material being introduced into said fiber bundles and with the outer layer of polymeric material being subsequently secured over said intermediate layer of polymeric material and defining said one surface of said layer means, the improvement comprising the step of disposing a slip agent comprising a low molecular weight polyethylene only in the intermediate polymeric layer comprising a neoprene or elastomeric latex so that said slip agent and said polymeric material of said intermediate layer will be introduced in combination into said fiber bundles whereby only said intermediate layer initially has a slip agent therein that under certain cure conditions will migrate from said fiber bundles through said outer polymeric layer initially comprising a latex not bearing said slip agent to the outer surface thereof to provide a degree of reduction in the surface coefficient of friction for said contact face of said product.

2. A method of making a layer means as set forth in claim 1 wherein said step of securing comprises the step of first coating said intermediate layer in liquid form against said one side of said fabric layer and then coating said outer layer in liquid form against said intermediate layer.

3. A method of making a layer means as set forth in claim 1 and including the step of securing polymeric material to the other of said sides of said fabric layer to define said other surface means thereof that is to be secured to said surface of said product.

4. In a method of making a polymeric-coated fabric layer means having opposed surfaces one of which is adapted to be secured to a surface of a polymeric product and the other of which is adapted to be a contact face for said product, said method comprising the steps of forming said fabric layer means to comprise a fabric layer having opposed sides and fiber bundles, and securing two layers of polymeric material in stacked relation to one of said sides of said fabric layer with the intermediate layer of polymeric material being introduced into said fiber bundles and with the outer layer of polymeric material being subsequently secured over said intermediate layer of polymeric material and defining said one surface of said layer means, the improvement comprising the step of disposing a slip agent comprising a low molecular weight polyethylene only in the intermediate polymeric layer comprising a neoprene so that said slip agent and said polymeric material of said intermediate layer will be introduced in combination into said fiber bundles whereby only said intermediate layer initially has a slip agent therein that under certain cure conditions will migrate from said fiber bundles through said outer polymeric layer initially comprising a latex not bearing said slip agent to the outer surface thereof to provide a degree of reduction in the surface coefficient of friction for said contact face of said product.

5. A method of making a layer means as set forth in claim 4 wherein said step of securing comprises the step of first coating said intermediate layer in liquid form against said one side of said fabric layer and then coating said outer layer in liquid form against said intermediate layer.

6. A method of making a layer means as set forth in claim 4 and including the step of securing polymeric material to the other of said sides of said fabric layer to define said other surface means thereof that is to be secured to said surface of said product.

7. In a method of making a polymeric-coated fabric layer means having opposed surfaces one of which is adapted to be secured to a surface of a polymeric product and the other of which is adapted to be a contact face for said product, said method comprising the steps of forming said fabric layer means to comprise a fabric layer having opposed sides and fiber bundles, and securing two layers of polymeric material in stacked relation to one of said sides of said fabric layer with the intermediate layer of polymeric material being introduced into said fiber bundles and with the outer layer of polymeric material being subsequently secured over said intermediate layer of polymeric material and defining said one surface of said layer means, the improvement comprising the step of disposing a slip agent comprising a low molecular weight polyethylene only in the intermediate polymeric layer comprising an elastomeric latex so that said slip agent and said polymeric material of said intermediate layer will be introduced in combination into said fiber bundles whereby only said intermediate layer initially has a slip agent therein that under certain cure conditions will migrate from said fiber bundles through said outer polymeric layer initially comprising a latex not bearing said slip agent to the outer surface thereof to provide a degree of reduction in the surface coefficient of friction for said contact face of said product.

8. A method of making a layer means as set forth in claim 7 wherein said step of securing comprises the step of first coating said intermediate layer in liquid form against said one side of said fabric layer and then coating said outer layer in liquid form against said intermediate layer.

9. A method of making a layer means as set forth in claim 8 and including the step of securing polymeric material to the other of said sides of said fabric layer to define said other surface means thereof that is to be secured to said surface of said product.

* * * * *